US007284616B2

(12) United States Patent
Williams et al.

(10) Patent No.: US 7,284,616 B2
(45) Date of Patent: Oct. 23, 2007

(54) SELECTIVELY RETRIEVABLE WEAR BUSHING FOR SUBSEA OR SURFACE APPLICATIONS

(75) Inventors: Gregory D. Williams, Houston, TX (US); Christopher L. Ognoskie, Katy, TX (US); John A. Beleski, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 267 days.

(21) Appl. No.: 10/946,781

(22) Filed: Sep. 22, 2004

(65) Prior Publication Data

US 2005/0103503 A1 May 19, 2005

Related U.S. Application Data

(60) Provisional application No. 60/505,012, filed on Sep. 22, 2003.

(51) Int. Cl.
*E21B 23/00* (2006.01)
*E21B 17/21* (2006.01)
*E21B 7/12* (2006.01)

(52) U.S. Cl. ..... 166/381; 166/85.3

(58) Field of Classification Search ..... 175/325.1, 175/325.2; 166/85.1, 85.3, 381
See application file for complete search history.

(56) References Cited

U.S. PATENT DOCUMENTS

| | | | | |
|---|---|---|---|---|
| 3,247,914 | A * | 4/1966 | Slack | 175/7 |
| 5,199,495 | A * | 4/1993 | Brammer et al. | 166/339 |
| 5,762,136 | A * | 6/1998 | Oswald | 166/85.3 |
| 6,749,018 | B1 | 6/2004 | Ford et al. | 166/85.3 |
| 2002/0092656 | A1 | 7/2002 | Ford et al. | 166/377 |

* cited by examiner

*Primary Examiner*—David Bagnell
*Assistant Examiner*—Robert Fuller
(74) *Attorney, Agent, or Firm*—Paul R. Morico; Baker Botts L.L.P.

(57) ABSTRACT

The present invention is directed to an assembly for installing and selectively retrieving a wear bushing in the bore of a subsea or surface wellhead. The assembly includes a bit sub, which is adapted for attachment to a drill string, a drill string adapter removably coupled to the bit sub, and a wear bushing removably coupled to the drill string adapter and adapted to be recoupled to the drill string adapter for selective retrieval from the bore of the wellhead.

24 Claims, 12 Drawing Sheets

SELECTIVELY RETRIEVABLE WEAR BUSHING FOR SUBSEA OR SURFACE APPLICATIONS

RELATED APPLICATION

This application claims the benefit of U.S. Provisional Patent Application Ser. No. 60/505,012, filed Sep. 22, 2003, which is herein incorporated by reference in its entirely as if set forth below.

FIELD OF THE INVENTION

The present invention relates generally to wear bushings for use in oil and gas wells, and, more particularly, to a wear bushing that can be installed and selectively retrieved from the bore of a surface or subsea wellhead.

BACKGROUND OF THE INVENTION

Wear bushings are used while drilling to protect the bore of a surface or subsea wellhead from damage or wear. The bore of the wellhead must be protected so that metal-to-metal seal assemblies can later be installed when a casing hanger is landed and the annulus between the wellhead bore and the casing run is "packed-off" with the metal seal assembly. Scratches in the wellhead bore would prevent the metal seal from passing pressure tests.

After a casing string is run in the wellhead, a special trip is typically made to install a shorter wear bushing with a smaller bore (via drill pipe) above the casing hanger to again protect the wellhead. Drilling can then commence again.

When subsea wellheads were initially introduced, they were used in shallow water depths, e.g., 300 feet (ft.)-500 feet (ft.). The time required to install (trip in) and retrieve (trip out) a wear bushing for such shallow depths was short. One trip was performed via drill pipe just to install the wear bushing and a separate trip was performed via drill pipe just to retrieve the wear bushing.

Later, designs of wear bushings were introduced to install and retrieve wear bushings while the drill bit and bottom hole assembly were being run and retrieved. These were called "bit runable wear bushings" and later shortened to "wear sleeves." A drawback of these designs is that every time the bit is retrieved, the wear sleeve is also retrieved. There is still risk involved with this process, however, because the drill bit passes through the exposed wellhead before the wear sleeve is installed and, on the trip out, the wear sleeve is retrieved first, and later the drill bit will pass through the exposed wellhead. In the case of the smaller, deeper drilling intervals, the drilled hole may require multiple trips because worn drill bits would have to be replaced before the desired depth of penetration is reached.

United States Patent Application Publication No. U.S. 2002/0092656 proposes another solution, which employs a selectively retrievable wear sleeve. The invention is a running tool having an enlarged diameter section fitted with a gripping mechanism designed to engage selectively the wear sleeve. The gripping mechanism is activated with hydrostatic pressure created using a plug, which engages a shoulder formed on the inner diameter of the running tool just below the gripping mechanism. A drawback of this design is that the plug blocks the ability to circulate the drilling fluid (mud) down hole. Thus, when the plug is dropped down the drill string, the plug then lands on a shoulder and the retrieval process begins. If, at this time, a well kick occurs and the blowout preventer (BOP) rams are closed, the operator is not permitted to circulate out the kick by pumping down the drill pipe and taking returns up through the Choke and Kill lines located below the blowout preventer (BOP) rams. Such a case of not being able to circulate out the kick can lead to a dangerous situation. A further drawback of this design is that the enlarged diameter section of the tool, which is designed to travel down hole with the rest of the drill string during the drilling operation, is large enough to interfere with the inner diameter of the casing string and thereby potentially damage the casing string.

SUMMARY OF THE INVENTION

The present invention is directed to a selectively retrievable wear bushing assembly that overcomes or at least minimizes some of the drawbacks of prior art wear sleeves.

The selectively retrievable wear bushing assembly according to the present invention comprises a bit sub adapted for coupling to the drill string, a drill string adapter removably coupled to the bit sub, and a wear bushing removably coupled to the drill string adapter and adapted for recoupling to the drill string adapter. The wear bushing according to the present invention is designed to stay in the wellhead when a drill bit and/or a bottom hole assembly is retrieved. The wear bushing or sleeve according to the present invention can be retrieved on the last trip out of the hole with the drill bit. With this design, the time savings of the "bit runable" feature can be enhanced with the improved risk factor of keeping the subsea or surface wellhead bore protected as much as possible while drill bits pass through the subsea or surface wellhead.

BRIEF DESCRIPTION OF THE DRAWINGS

A complete understanding of the present disclosure and advantages thereof may be acquired by referring to the following description taken in conjunction with the accompanying drawings, in which the leftmost significant digit(s) in the reference numerals denote(s) the first figure in which the respective reference numerals appear, wherein.

Figure 1A:
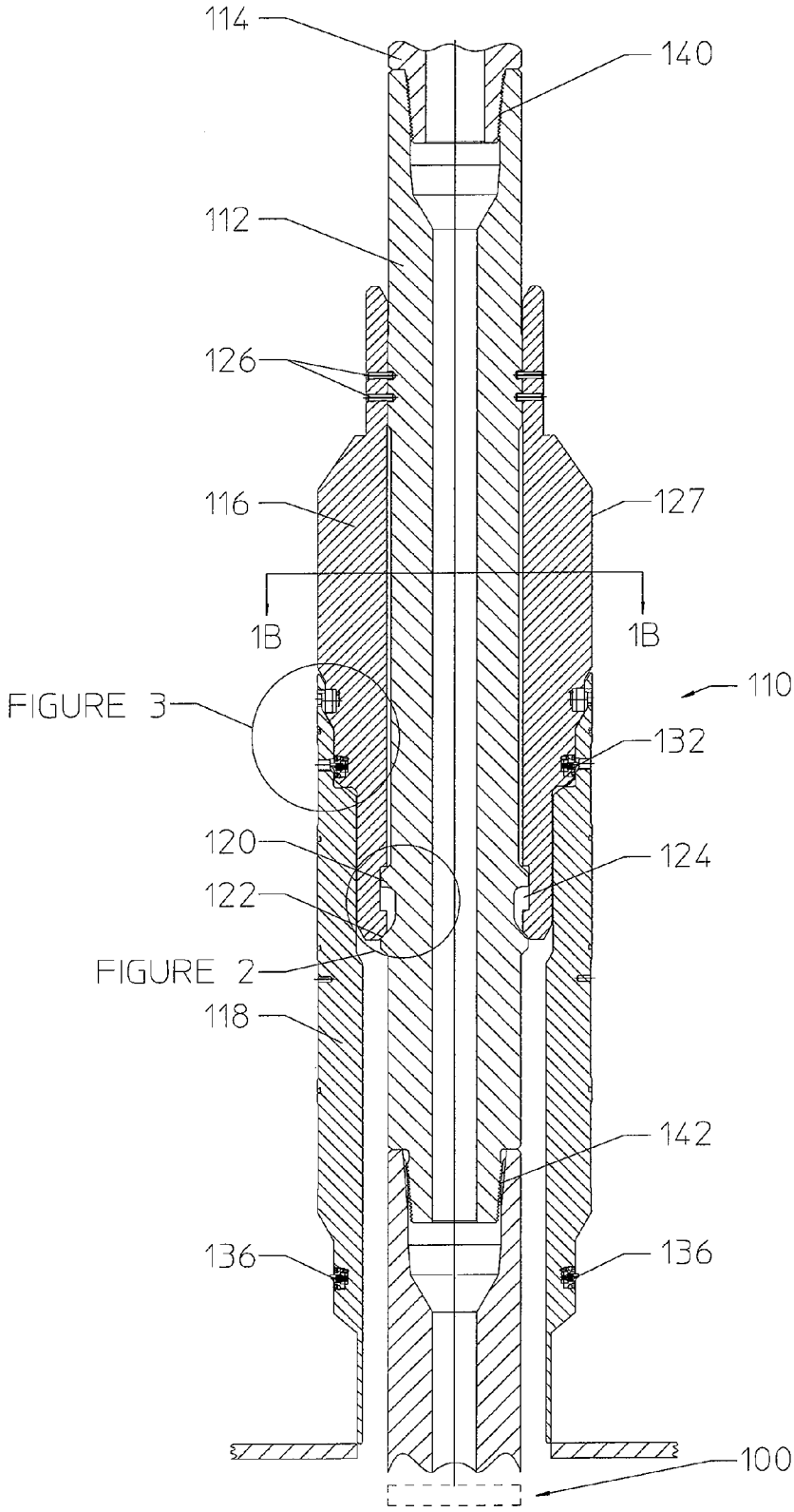
FIG. 1A schematically illustrates a longitudinal sectional view of a selectively retrievable wear bushing assembly according to various exemplary embodiments of the present invention shown in the made up position at the surface.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, alternatives, that fall within the spirit and scope of the invention as defined by the appended claims.

DETAILED DESCRIPTION OF THE INVENTION

Illustrative embodiments of the invention are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The details of various illustrative embodiments of the present invention will now be described with reference to the figures. Turning to FIG. 1A, a selectively retrievable wear bushing assembly in accordance with the present invention is shown generally by reference numeral 110. The selectively retrievable wear bushing assembly 110 includes a bit sub 112 coupled to a drill string 114, a drill string adapter 116 removably coupled to the bit sub 112, and a wear bushing 118 removably coupled to the drill string adapter 116 and adapted for recoupling to the drill string adapter 116. The drill string 114 may be coupled to a drill bit and/or a bottom hole assembly, as indicated in phantom by reference numeral 100.

The bit sub 112 is part of the drill string 114 and has a female thread 140 on an upper end of the bit sub 112 and a male thread 142 on a lower end of the bit sub 112. The bit sub 112 is formed with four J-lugs 120 equally spaced around an outer circumferential surface of the bit sub 112 at about a mid-section of the bit sub 112. The bit sub 112 also has a continuous stop shoulder 122 formed below the J-lugs 120.

Figure 1B:
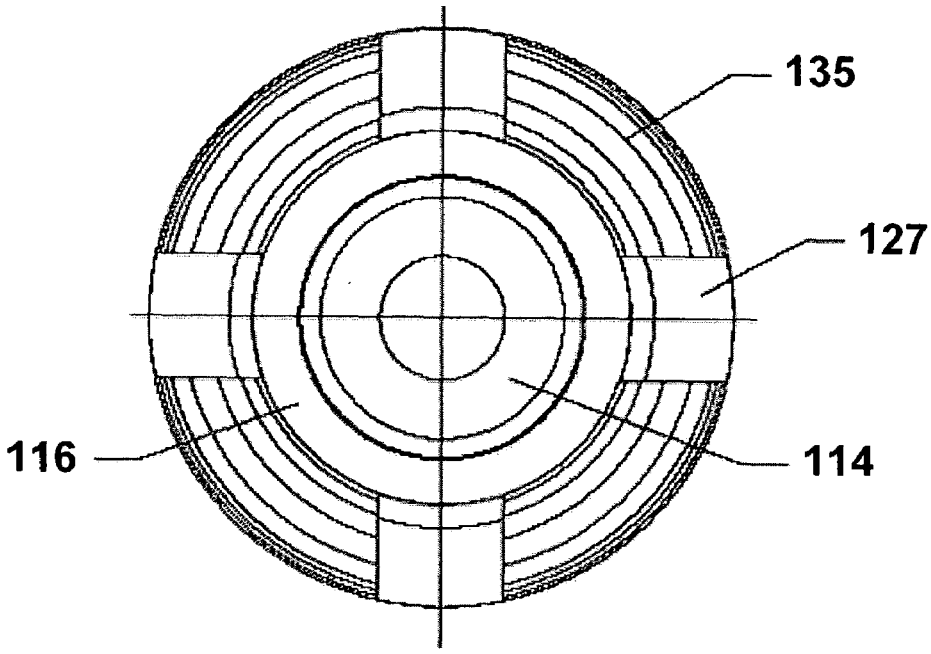
FIG. 1B schematically illustrates a top view of the selectively retrievable wear bushing assembly shown in FIG. 1A.
Figure 2:
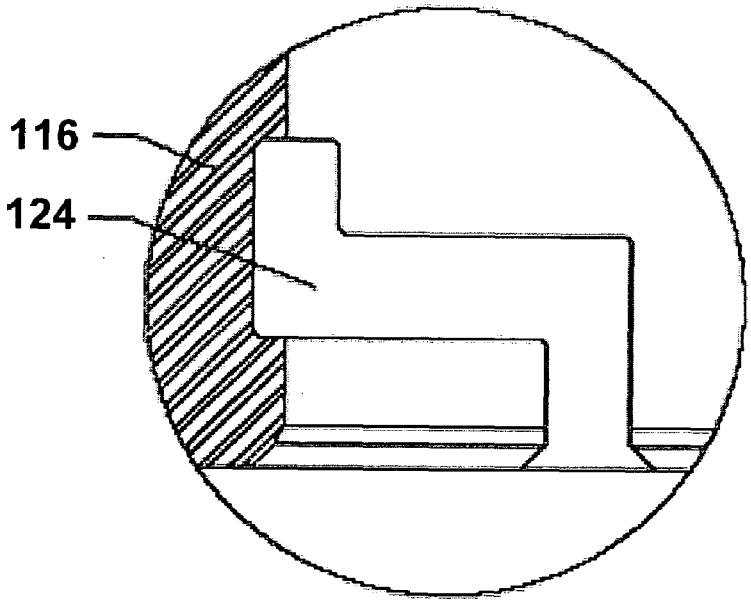
FIG. 2 schematically illustrates an enlarged sectional view of J-slots formed in the inner circumferential surface of the drill string adapter according to various exemplary embodiments of the present invention.
Figure 3:
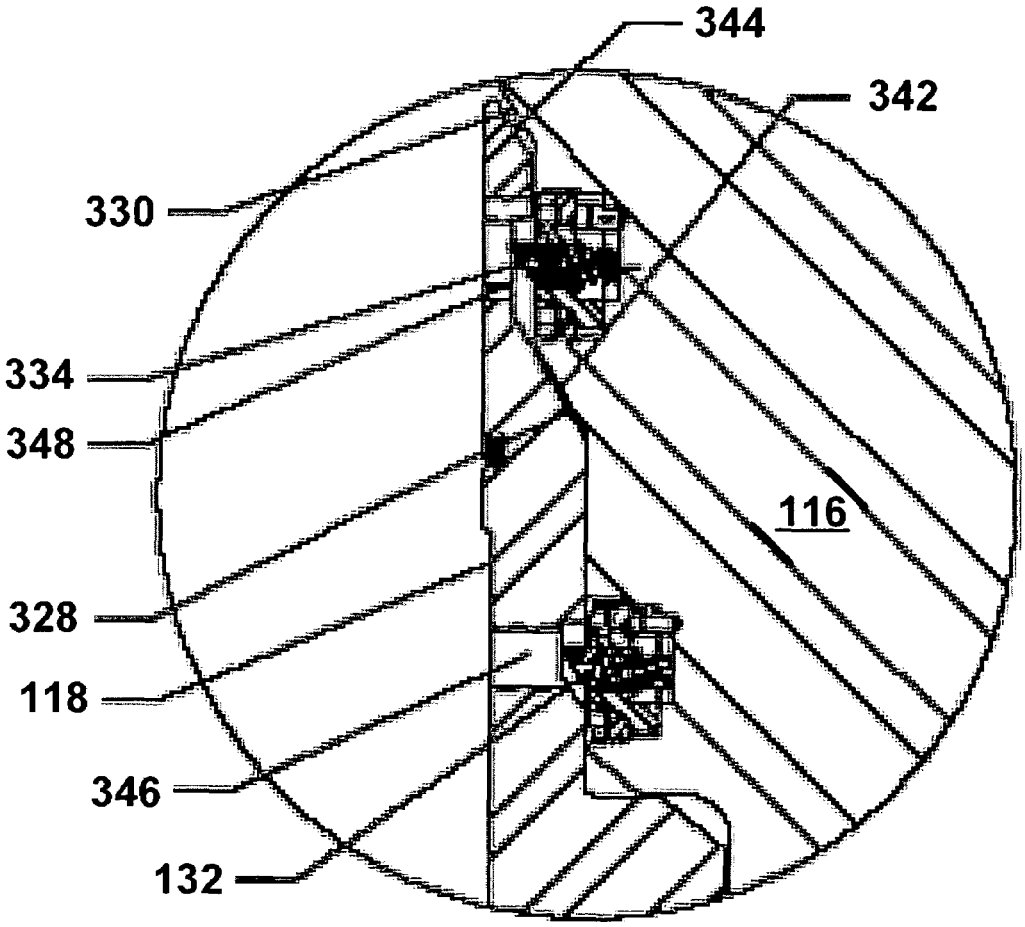
FIG. 3 schematically illustrates an enlarged sectional view of a mechanism that couples the drill string adapter to the wear bushing according to various exemplary embodiments of the present invention.

The drill string adapter 116 is formed with four J-slots 124 equally spaced around an inner circumferential surface of the drill string adapter 116 proximate one end, as shown in FIGS. 1A and 2. The four J-slots 124 correspond to, and are adapted to engage with, the four J-lugs 120 on the bit sub 112. Eight shear pins 126 (four of which are shown in FIG. 1A) rotationally and axially fix the drill string adapter 116 to the bit sub 112. The drill string adapter 116 has four equally spaced ribs 127 formed on an outer surface of the drill string adapter 116, as best shown in FIGS. 1A and 1B. Two adjacent shoulders 328 and 330 (as shown in FIG. 3, for example) are formed on each of the four ribs 127. The lower shoulder 328 is closer to the axial center of the drill string 114 assembly than the upper shoulder 330. Four grooves equally spaced around the outer circumferential surface of the drill string adapter 116 are formed in each of the shoulders 328 and 330. Each of the grooves in the shoulder 328 has a threaded pocket, which accepts a spring-loaded shear pin assembly 132, as shown in FIG. 3. Each of the grooves in the shoulder 330 is formed with two side-by-side threaded pockets, which accept two corresponding spring-loaded shear pin assemblies 334, one of which can be seen in FIG. 3. Thus, the grooves in the lower shoulder 328 are designed to accommodate four spring-loaded shear pin assemblies 132 and the grooves in the upper shoulder 330 are designed to accommodate eight spring-loaded shear pin assemblies 334. Preferably, the shear pins for insertion in the grooves of the lower shoulder 328 are standard strength (standard duty), i.e., designed to fail at a load of about 7,500 pounds (lbs), and the shear pins for insertion into the grooves of the upper shoulder 330 are high strength (heavier duty), i.e., designed to fail at a load of about 15,000 pounds (lbs) or more. Four equally-spaced flow-by slots 135 are formed between the adjacent ribs 127, as shown in FIG. 1B. The flow-by slots 135 are provided to maximize circulation of the drilling fluid (mud) back up the drilling riser system.

Figure 4:
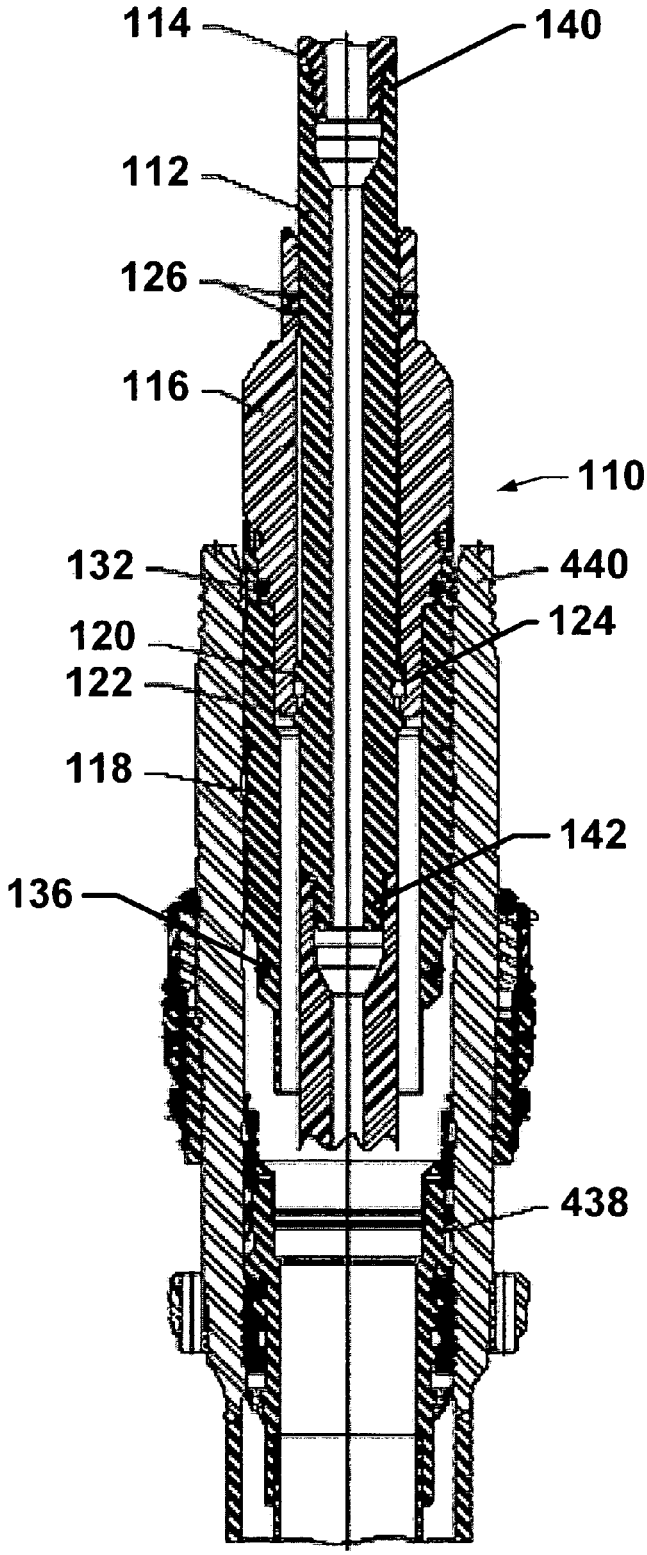
FIG. 4 schematically illustrates a longitudinal sectional view of a selectively retrievable wear bushing assembly according to various exemplary embodiments of the present invention shown in the wellhead just prior to installation during the initial trip.

The wear bushing 118 is preferably formed of metal and generally cylindrical in shape. Indeed, the wear bushing 118 is similar in construction to conventional wear bushings used to protect the bores of surface and subsea wellheads. The wear bushing 118 has eight threaded pockets spaced around an outer circumferential surface of the wear bushing 118 that are designed to accommodate eight corresponding spring-loaded shear pin assemblies 136, two of which can be seen in FIG. 1A. The shear pins in these spring-loaded shear pin assemblies 136 are designed to lock into corresponding recesses formed in a casing hanger or landing shoulder 438 within a wellhead 440, as shown in FIG. 4. Unlike conventional wear bushings, however, the wear bushing 118 has anti-rotation slots and tapped retraction holes formed on an outside circumferential surface of the wear bushing 118. The wear bushing 118 is also formed with two shoulders 342 and 344, which are designed to interlock with the shoulders 328 and 330 of the drill string adapter 116, respectively, as shown in FIG. 3. The upper and lower shoulders 342 and 344 have corresponding recesses 346 and 348 into which shear pins of the spring-loaded shear pin assemblies 132 and 334 lock once aligned.

The operation of the selectively retrievable wear bushing assembly 110 will be now be described. First, the selectively retrievable wear bushing assembly 110 in accordance with various illustrative embodiments of the present invention is set up for initial installation of the wear bushing 118 within the bore of the wellhead 440. Setup of the selectively retrievable wear bushing assembly 110 includes the following steps: (1) installing four spring-loaded shear pin assemblies 132 in the pockets of the lower shoulder 328 only; (2) installing the eight spring-loaded shear pin assemblies 136 in the pockets of the wear bushing 118; and (3) assembling the bit sub 112, the drill string adapter 116, and the wear bushing 118, which this includes fitting the J-lugs 120 on the bit sub 112 into the corresponding J-slots 124 in the drill string adapter 116, rotationally and axially fixing the drill string adapter 116 to the bit sub 112 with the eight shear pins 126, and locking the shear pins of the four spring-loaded shear pin assemblies 132 in the pockets of the lower shoulder 328 into the corresponding recesses 346 formed in the wear bushing 118.

Figure 5:
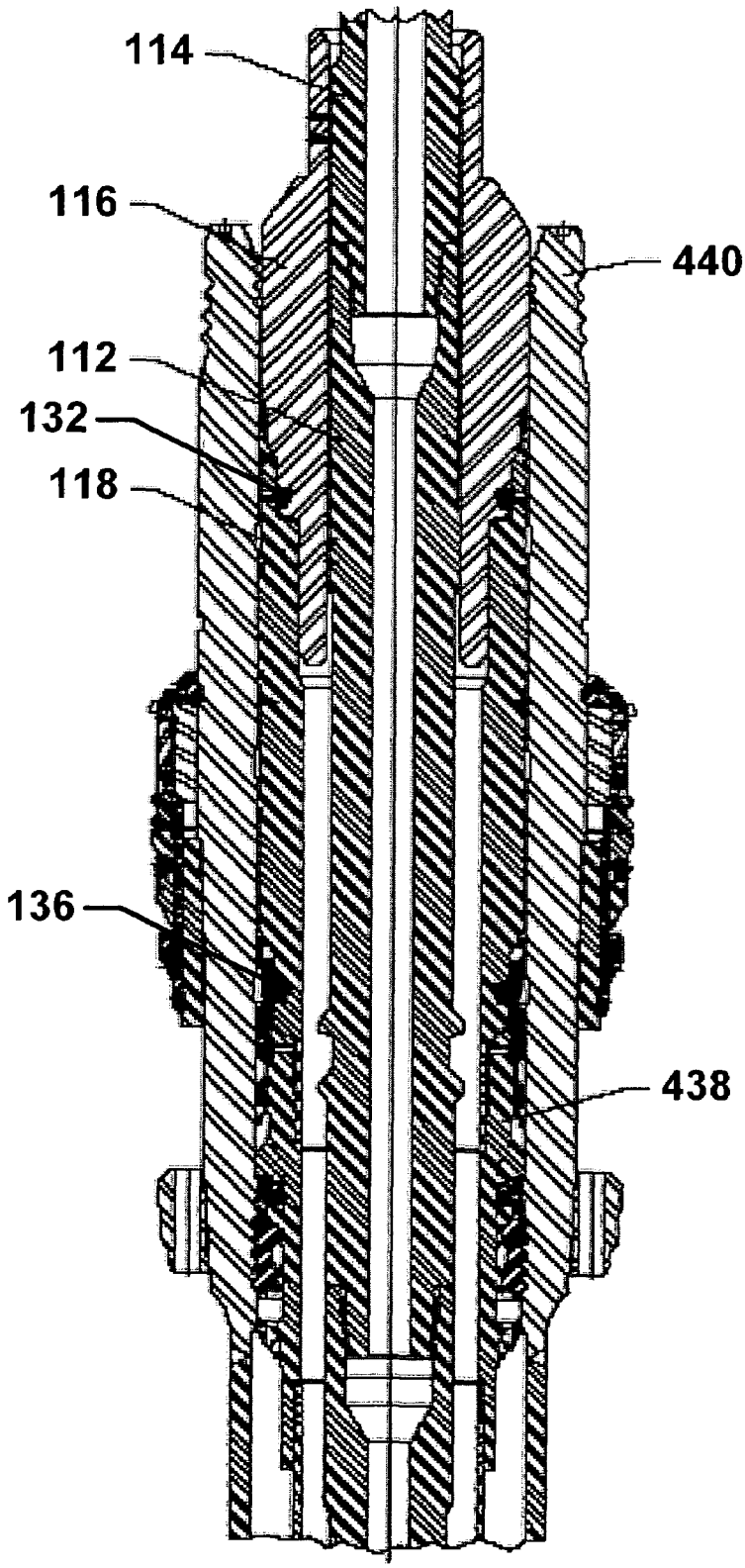
FIG. 5 schematically illustrates the same view as FIG. 4 showing the selectively retrievable wear bushing assembly in the wellhead in the installed position during the same initial trip.
Figure 6:
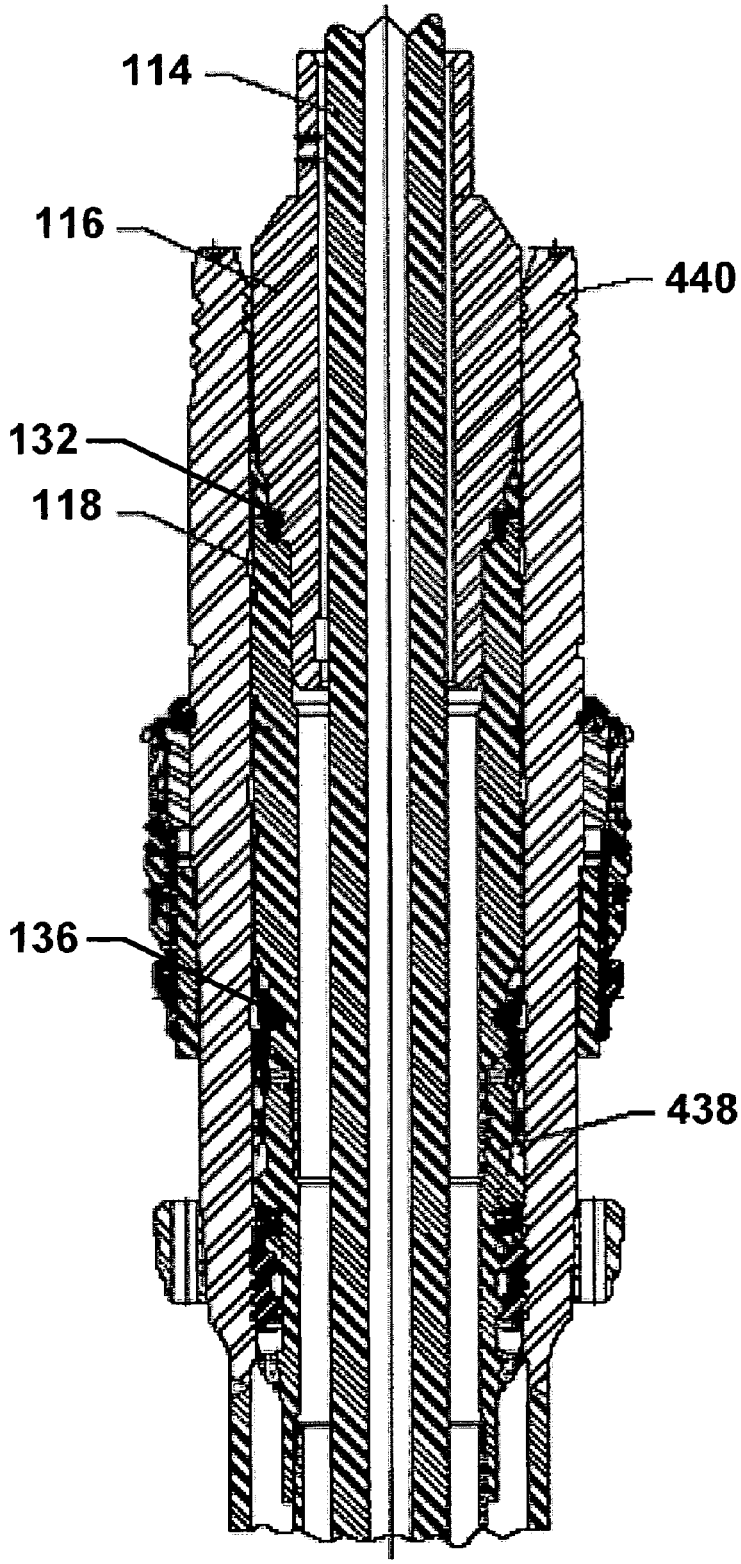
FIG. 6 schematically illustrates the same view as FIGS. 4-5 showing the drill pipe in the drilling position during the same initial trip.

Next, the drill string 114 is lowered into the subsea or surface wellhead 440 and the wear bushing 118 lands on the casing hanger or landing shoulder 438 in the wellhead 440, as shown in FIGS. 4 and 5. The wear bushing 118 may be secured to the casing hanger 438 and/or the wellhead 440 via the eight spring-loaded shear pins 136, and the drill string adapter 116 may be secured to the wear bushing 118 via the four spring-loaded shear pins 132. Next, a downward weight and a right-hand torque are applied to the drill string 114, causing the shear pins 126 to fail and un-jaying the bit sub 112 from the drill string adapter 116. The downward weight being continuously applied to the drill string 114 allows the bit sub 112 to trip down hole, as shown in FIG. 6, for example, with the bottom hole assembly 100.

Figure 7:
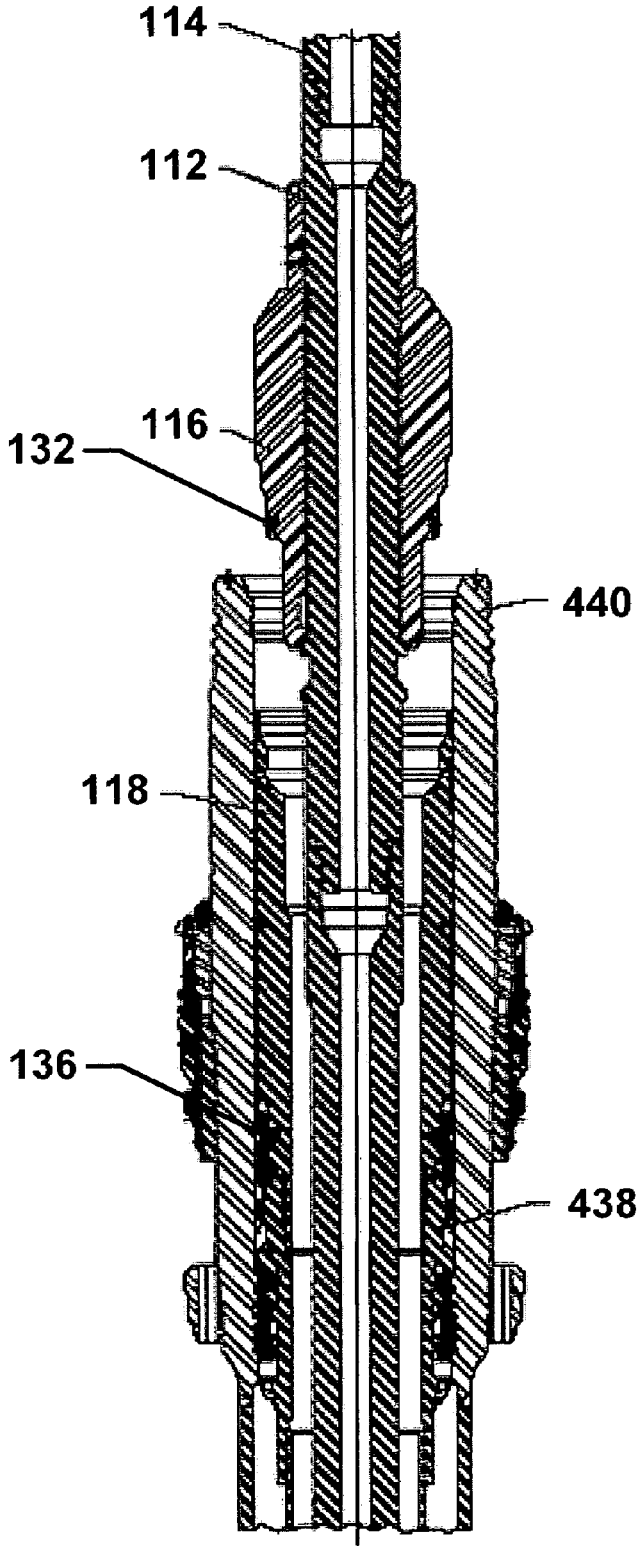
FIG. 7 schematically illustrates the same view as FIGS. 4-6 showing the drill string adapter and bit sub portions of the selectively retrievable wear bushing assembly being retrieved on the trip out of the initial trip.

If the drill bit 100 becomes worn or damaged before the final depth is reached, the drill bit 100 must be tripped out of the hole. As the bit sub 112 makes contact with the drill string adapter 116, the bit sub 112 contacts a solid shoulder and/or the J-lugs 120 make contact with a solid shoulder. Continued pull on the drill string 114 will shear the four spring-loaded shear pins 132, leaving the wear bushing 118 in place and retrieving the drill string adapter 116 back to the surface, as shown in FIG. 7.

Figure 8:
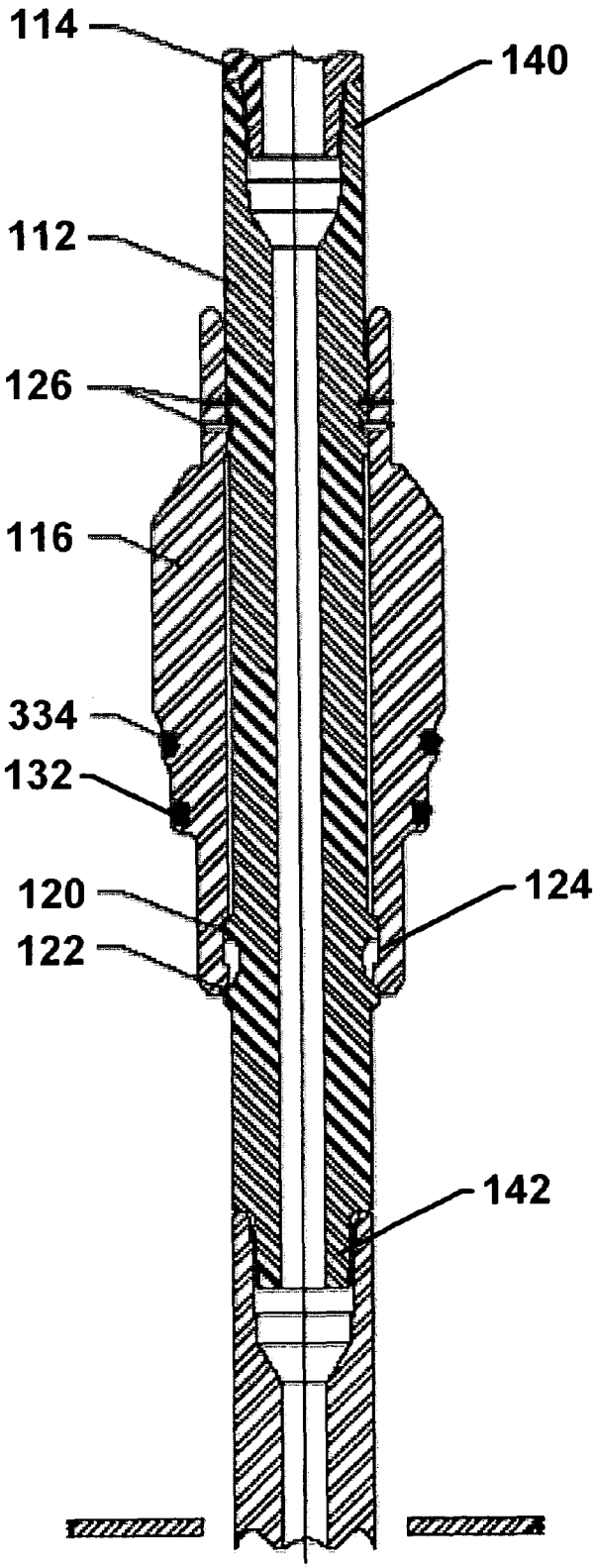
FIG. 8 schematically illustrates a longitudinal sectional view of the drill string adapter and bit sub at the surface being made up for the final trip where the wear bushing will be selectively retrieved.
Figure 9:
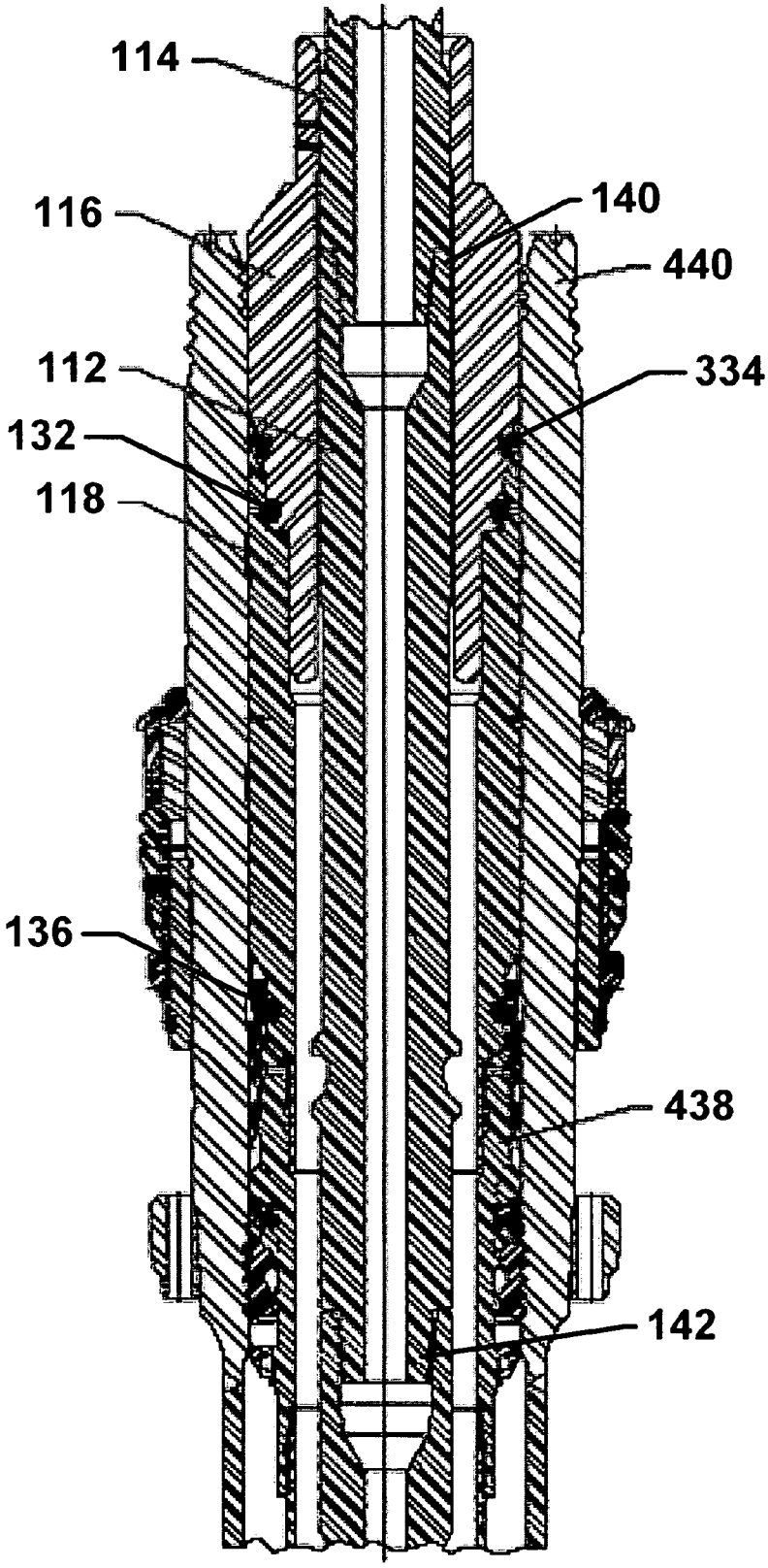
FIG. 9 schematically illustrates a longitudinal sectional view of the drill string adapter and bit sub being engaged with the wear bushing at the wellhead.
Figure 10:
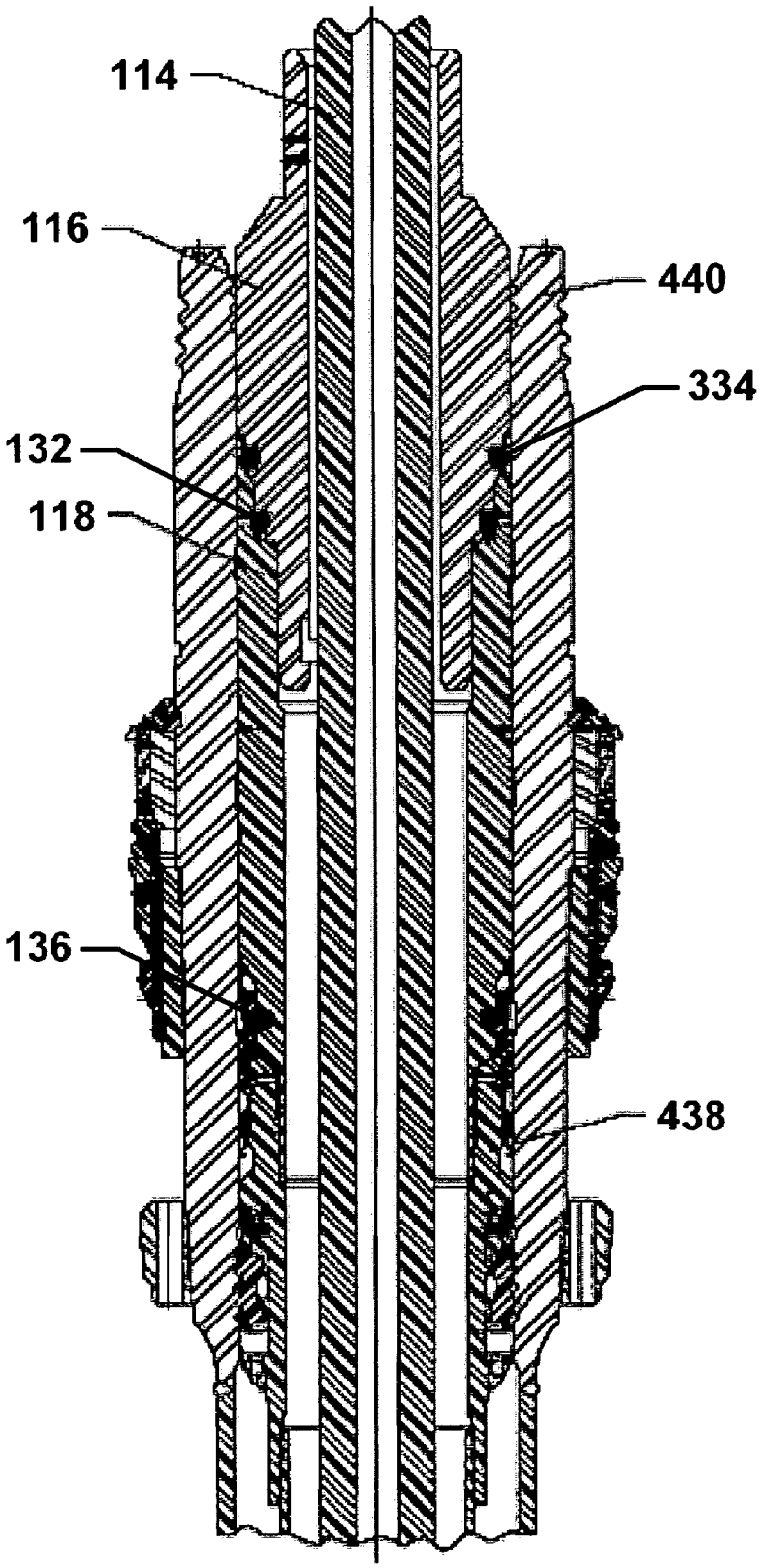
FIG. 10 schematically illustrates a same view as FIG. 6 showing the drill pipe in the drilling position during the final trip.
Figure 11:
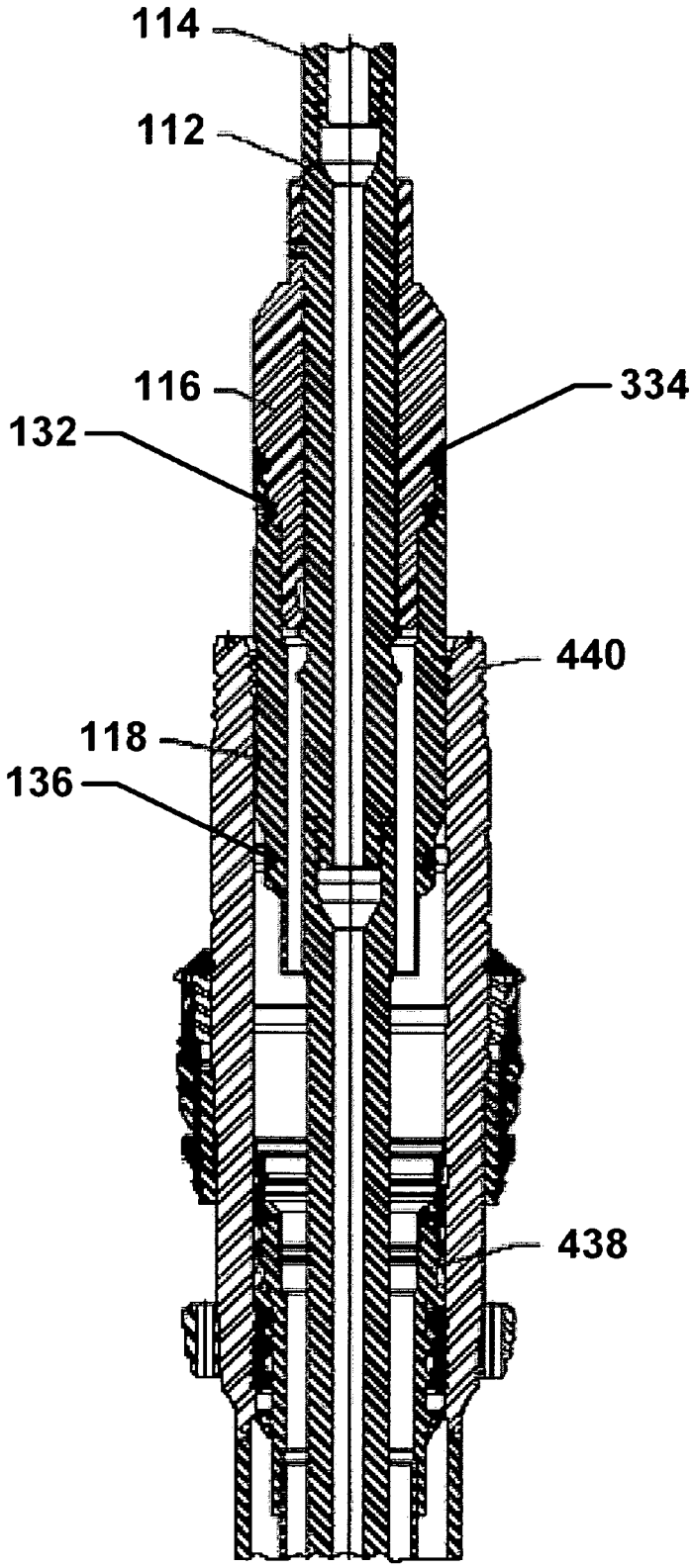
FIG. 11 schematically illustrates the same view as FIG. 7 showing the selectively retrievable wear bushing disengaged from the wellhead bore during the final trip out after drilling is complete.

If it is decided that on the next drill bit 100 run the wear bushing 118 must be retrieved, then eight heavier duty spring-loaded shear pins 334 are added to the second level of shear pin pockets, in the upper shoulder 330 on the drill string adapter 116 along with the original four spring-loaded shear pins 132 on the first level, in the lower shoulder 328, as shown in FIG. 8. The bit sub 112 and the drill string adapter 116 are run with the drill string 114 again, as before, and the drill string adapter 116 will land on the wear bushing 118, as shown in FIG. 9. All eight of the heavier duty shear pins 334 and all four of the standard duty shear pins 132 will snap into the corresponding recesses 346 and 348 formed in the wear bushing 118. The bit sub 112 is un-jayed, as before, and the drill string 114 continues down hole as before, as shown in FIG. 10. As the drill string 114 is retrieved, the bit sub 112 contacts a solid shoulder on the drill string adapter 116, as before, but this time, as the drill string 114 is pulled upward, the four standard duty shear pins 132 and the eight heavier duty shear pins 334 keep the drill string adapter 116 attached to the wear bushing 118, which is tripped out of the wellhead 440 back to the surface because the eight standard duty shear pins 136 holding the wear bushing 118 to the casing hanger 438 and/or the wellhead 440 fail under the axial force being applied by the drill string 114, as shown in FIG. 11.

If there are any intermediate drill bit 100 trips where it is intended to leave the wear bushing 118 in the wellhead 440, the drill string adapter 116 is simply not installed on the drill string 114.

Figure 12:
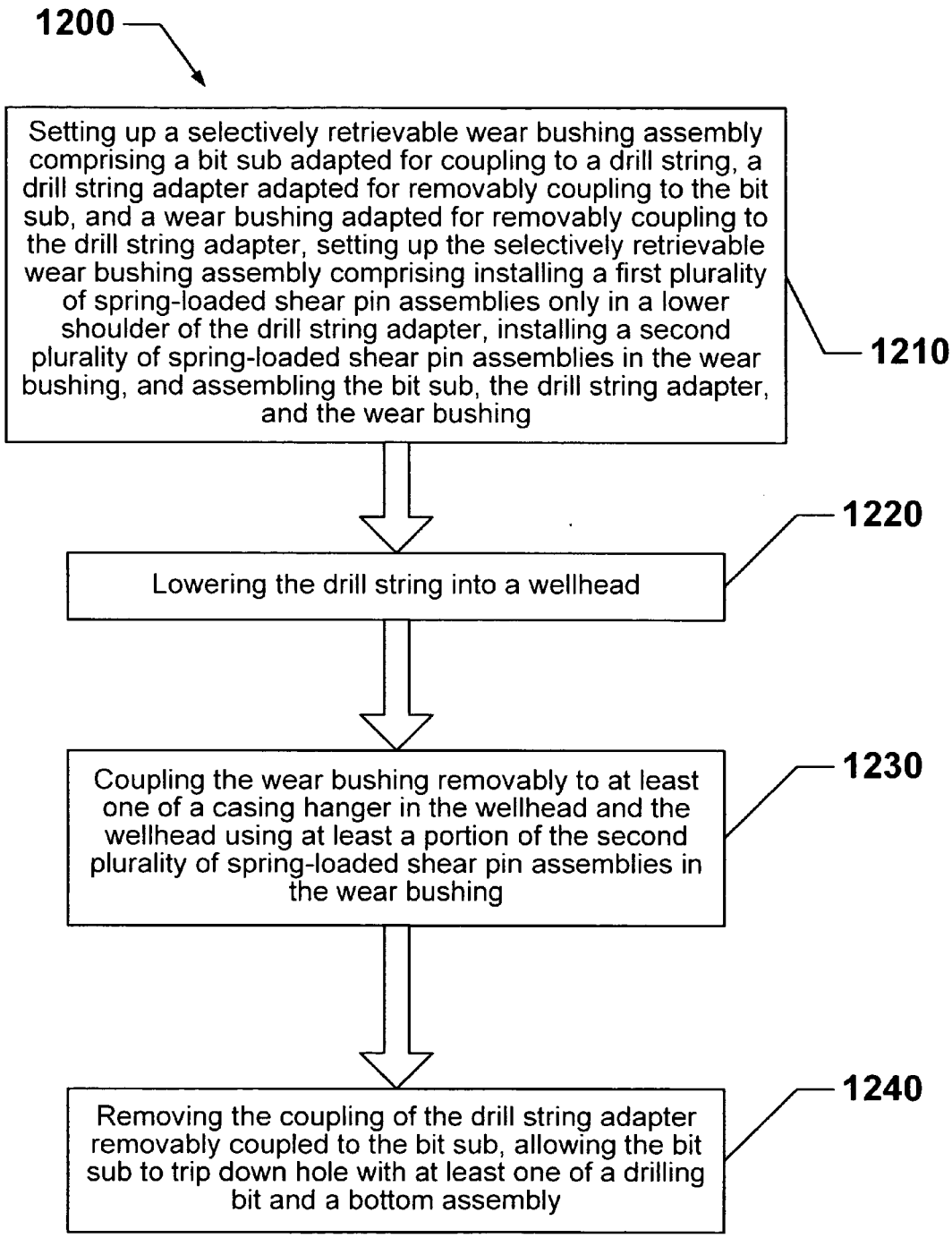
FIG. 12 schematically illustrates an exemplary embodiment of a method according to the present invention for installing, and selectively retrieving, a selectively retrievable wear bushing.

In various illustrative embodiments, as shown in FIG. 12, a method 1200 of for installing and selectively retrieving a selectively retrievable wear bushing may be provided. The method 1200 may comprise setting up a selectively retrievable wear bushing assembly comprising a bit sub adapted for coupling to a drill string, a drill string adapter adapted for removably coupling to the bit sub, and a wear bushing adapted for removably coupling to the drill string adapter, setting up the selectively retrievable wear bushing assembly comprising installing a first plurality of spring-loaded shear pin assemblies only in a lower shoulder of the drill string adapter, installing a second plurality of spring-loaded shear pin assemblies in the wear bushing, and assembling the bit sub, the drill string adapter, and the wear bushing, as indicated at 1210. For example, as described above, the selectively retrievable wear bushing assembly 110, comprising the bit sub 112 adapted for coupling to the drill string 114, the drill string adapter 116 adapted for removably coupling to the bit sub 112, and the wear bushing 118 adapted for removably coupling to the drill string adapter 116, may be set up by installing the first plurality of spring-loaded shear pin assemblies 132 only in the lower shoulder 328 of the drill string adapter 116, installing the second plurality of spring-loaded shear pin assemblies 136 in the wear bushing 118, and assembling the bit sub 112, the drill string adapter 116, and the wear bushing 118.

The method 1200 may also comprise lowering the drill string into a wellhead, as indicated at 1220, and coupling the wear bushing removably to at least one of a casing hanger in the wellhead and the wellhead using at least a portion of the second plurality of spring-loaded shear pin assemblies in the wear bushing, as indicated at 1230. For example, as described above, the drill string 114 may be lowered into the wellhead 440, and the wear bushing 118 may be removably coupled to at least one of the casing hanger 438 in the wellhead 440 and the wellhead 440, using at least a portion of the second plurality of spring-loaded shear pin assemblies 136 in the wear bushing 118.

The method 1200 may also comprise removing the coupling of the drill string adapter removably coupled to the bit sub, allowing the bit sub to trip down hole with at least one of a drill bit and a bottom hole assembly, as indicated at 1240. For example, as described above, the coupling of the drill string adapter 116 removably coupled to the bit sub 112 may be removed, allowing the bit sub 112 to trip down hole with at least one of the drill bit 100 and/or the bottom hole assembly 100.

Therefore, the various illustrative embodiments of the present invention enabled and described herein are well adapted to carry out the objects and attain the ends and advantages mentioned, as well as those that are inherent therein. While the present invention has been depicted, described, and defined by reference to exemplary embodiments of the present invention, such a reference does not imply any limitation of the present invention, and no such limitation is to be inferred. The present invention is capable of considerable modification, alteration, and equivalency in form and function as will occur to those of ordinary skill in the pertinent arts having the benefit of this disclosure. The depicted and described illustrative embodiments of the present invention are exemplary only and are not exhaustive of the scope of the present invention. Consequently, the present invention is intended to be limited only by the spirit and scope of the appended claims, giving full cognizance to equivalents in all respects.

The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, in the sense of Georg Cantor. Accordingly, the protection sought herein is as set forth in the claims below.

What is claimed is:

1. A selectively retrievable wear bushing assembly comprising:

a bit sub adapted for coupling to a drill string;

a drill string adapter removably coupled to the bit sub comprising:

a plurality of J lugs substantially equally spaced around an outer circumferential surface of the bit sub at about a mid section of the bit sub; and a plurality of J slots substantially equally spaced around an inner circumferential surface of the drill string adapter proximate one end of the drill string adapter; and a wear bushing removably coupled to the drill string adapter.

2. A selectively retrievable wear bushing assembly comprising:

a bit sub adapted for coupling to a drill string;

a drill string adapter removably coupled to the bit sub; and a wear bushing removably coupled to the drill string adapter comprising:

a plurality of ribs substantially equally spaced and disposed on an outer surface of the drill string adapter;

a plurality of flow by slots disposed between adjacent ribs of the plurality of ribs, the plurality of flow by slots adapted to allow circulation of a drilling fluid back up a drilling riser system;

at least two shoulders formed on each of the plurality of ribs, each of the at least two shoulders adapted to accept at least one spring loaded shear pin assembly; and at least two shoulders disposed on an inner surface of the wear bushing, the at least two shoulders of the wear bushing adapted to interlock with the at least two shoulders of the drill string adapter, the at least two shoulders of the wear bushing each having at least one recess adapted to accept shear pins of the at least one spring loaded shear pin assembly.

3. A selectively retrievable wear bushing assembly comprising:

a bit sub adapted for coupling to a drill string;

a drill string adapter removably coupled to the bit sub; and a wear bushing removably coupled to the drill string adapter;

wherein the wear bushing is adapted for recoupling to the drill string adapter;

wherein the wear bushing is adapted to stay in a wellhead when at least one of a drill bit and a bottom hole assembly is retrieved;

wherein the wear bushing is adapted to be retrieved on a last trip out of a hole along with a drill bit; and wherein the wear bushing removably coupled to the drill string adapter and adapted for recoupling to the drill string adapter further comprises:

a plurality of ribs substantially equally spaced and disposed on an outer surface of the drill string adapter;

a plurality of flow by slots disposed between adjacent ribs of the plurality of ribs, the plurality of flow by slots adapted to allow circulation of a drilling fluid back up a drilling riser system;

at least two shoulders formed on each of the plurality of ribs, each of the at least two shoulders adapted to accept at least one spring loaded shear pin assembly; and at least two shoulders disposed on an inner surface of the wear bushing, the at least two shoulders of the wear bushing adapted to interlock with the at least two shoulders of the drill string adapter, the at least two shoulders of the wear bushing each having at least one recess adapted to accept shear pins of the at least one spring loaded shear pin assembly, wherein one of the at least two shoulders of the drill string adapter is adapted to accept at least one spring loaded shear pin assembly having a heavier duty spring loaded shear pin, the heavier duty spring loaded shear pin adapted to fail at a higher load than a standard duty spring loaded shear pin.

4. The selectively retrievable wear bushing assembly of claim 3, wherein the heavier duty spring loaded shear pin is adapted to fail at a load of at least about 15,00 pounds and the standard duty spring loaded shear pin is adapted to fail at a load of about 7,500 pounds.

5. A method comprising:

setting up a selectively retrievable wear bushing assembly comprising a bit sub adapted for coupling to a drill string, a drill string adapter adapted for removably coupling to the bit sub, and a wear bushing adapted for removably coupling to the drill string adapter, setting up the selectively retrievable wear bushing assembly comprising installing a first plurality of spring loaded shear pin assemblies only in a lower shoulder of the drill string adapter, installing a second plurality of spring loaded shear pin assemblies in the wear bushing, and assembling the bit sub, the drill string adapter, and the wear bushing;

lowering the drill string into a wellhead;

coupling the wear bushing removably to at least one of a casing hanger in the wellhead and the wellhead using at least a portion of the second plurality of spring loaded shear pin assemblies in the wear bushing; and removing the coupling of the drill string adapter removably coupled to the bit sub, allowing the bit sub to trip down hole with at least one of a drill bit and a bottom hole assembly.

6. The method of claim 5, wherein assembling the bit sub, the drill string adapter, and the wear bushing further comprises fitting a plurality of J lugs substantially equally spaced around an outer circumferential surface of the bit sub at about a mid section of the bit sub into a plurality of J slots substantially equally spaced around an inner circumferential surface of the drill string adapter proximate one end of the drill string adapter.

7. The method of claim 5, wherein assembling the bit sub, the drill string adapter, and the wear bushing further comprises rotationally and axially fixing the drill string adapter to the bit sub with a plurality of shear pins.

8. The method of claim 5, wherein assembling the bit sub, the drill string adapter, and the wear bushing further comprises coupling the wear bushing removably to the drill string adapter using at least a portion of the first plurality of spring loaded shear pin assemblies in the lower shoulder of the drill string adapter.

9. The method of claim 5, wherein removing the coupling of the drill string adapter removably coupled to the bit sub further comprises applying a downward weight and a torque to the drill string.

10. The method of claim 5 further comprising:

tripping the bit sub out of the wellhead, the bit sub making contact with the drill string adapter;

continuing to pull on the drill string removing the coupling of the drill string adapter removably coupled to the wear bushing;

leaving the wear bushing removably coupled to the at least one of the casing hanger in the wellhead and the wellhead; and retrieving the drill string adapter.

11. The method of claim 10 further comprising:

setting up a selectively retrievable wear bushing retrieval assembly comprising the bit sub adapted for coupling to the drill string, and the drill string adapter adapted for removably coupling to the bit sub and for coupling to the wear bushing, setting up the selectively retrievable wear bushing retrieval assembly comprising installing the first plurality of spring loaded shear pin assemblies only in the lower shoulder of the drill string adapter, installing a third plurality of spring loaded shear pin assemblies only in the upper shoulder of the drill string adapter, and assembling the bit sub and the drill string adapter;

lowering the drill string into the wellhead; and coupling the wear bushing to the drill string adapter using at least a portion of the first plurality of spring loaded shear pin assemblies in the lower shoulder of the drill string adapter and at least a portion of the third plurality of spring loaded shear pin assemblies in the upper shoulder of the drill string adapter.

12. The method of claim 11 further comprising:

removing the coupling of the drill string adapter removably coupled to the bit sub, allowing the bit sub to trip down hole with at least one of a drill bit and a bottom hole assembly.

13. The method of claim 12 further comprising:

tripping the bit sub out of the wellhead, the bit sub making contact with the drill string adapter;

continuing to pull on the drill string removing the coupling of the wear bushing removably coupled to the at least one of the casing hanger in the wellhead and the wellhead; and retrieving the drill string adapter coupled to the wear bushing.

14. The method of claim 10 further comprising:

leaving the wear bushing in the wellhead on an intermediate drill bit trip by not installing the drill string adapter on the drill string.

15. A device comprising:

means for setting up a selectively retrievable wear bushing assembly comprising a bit sub adapted for coupling to a drill string, a drill string adapter adapted for removably coupling to the bit sub, and a wear bushing adapted for removably coupling to the drill string adapter, the means for setting up the selectively retrievable wear bushing assembly comprising means for installing a first plurality of spring loaded shear pin assemblies only in a lower shoulder of the drill string adapter, means for installing a second plurality of spring loaded shear pin assemblies in the wear bushing, and means for assembling the bit sub, the drill string adapter, and the wear bushing;

means for lowering the drill string into a wellhead;

means for coupling the wear bushing removably to at least one of a casing hanger in the wellhead and the wellhead using at least a portion of the second plurality of spring loaded shear pin assemblies in the wear bushing; and means for removing the coupling of the drill string adapter removably coupled to the bit sub, allowing the bit sub to trip down hole with at least one of a drill bit and a bottom hole assembly.

16. The device of claim 15, wherein the means for assembling the bit sub, the drill string adapter, and the wear bushing further comprises means for fitting a plurality of J lugs substantially equally spaced around an outer circumferential surface of the bit sub at about a mid section of the bit sub into a plurality of J slots substantially equally spaced around an inner circumferential surface of the drill string adapter proximate one end of the drill string adapter.

17. The device of claim 15, wherein the means for assembling the bit sub, the drill string adapter, and the wear bushing further comprises means for rotationally and axially fixing the drill string adapter to the bit sub with a plurality of shear pins.

18. The device of claim 15, wherein the means for assembling the bit sub, the drill string adapter, and the wear bushing further comprises means for coupling the wear bushing removably to the drill string adapter using at least a portion of the first plurality of spring loaded shear pin assemblies in the lower shoulder of the drill string adapter.

19. The device of claim 15, wherein the means for removing the coupling of the drill string adapter removably coupled to the bit sub further comprises means for applying a downward weight and a torque to the drill string.

20. The device of claim 15 further comprising:

means for tripping the bit sub out of the wellhead, the bit sub making contact with the drill string adapter;

means for continuing to pull on the drill string removing the coupling of the drill string adapter removably coupled to the wear bushing;

means for leaving the wear bushing removably coupled to the at least one of the casing hanger in the wellhead and the wellhead; and means for retrieving the drill string adapter.

21. The device of claim 20 further comprising:

means for setting up a selectively retrievable wear bushing retrieval assembly comprising the bit sub adapted for coupling to the drill string, and the drill string adapter adapted for removably coupling to the bit sub and for coupling to the wear bushing, the means for setting up the selectively retrievable wear bushing retrieval assembly comprising means for installing the first plurality of spring loaded shear pin assemblies only in the lower shoulder of the drill string adapter, means for installing a third plurality of spring loaded shear pin assemblies only in the upper shoulder of the drill string adapter, and means for assembling the bit sub and the drill string adapter;

means for lowering the drill string into the wellhead; and means for coupling the wear bushing to the drill string adapter using at least a portion of the first plurality of spring loaded shear pin assemblies in the lower shoulder of the drill string adapter and at least a portion of the third plurality of spring loaded shear pin assemblies in the upper shoulder of the drill string adapter.

22. The device of claim 21 further comprising:

means for removing the coupling of the drill string adapter removably coupled to the bit sub, allowing the bit sub to trip down hole with at least one of a drill bit and a bottom hole assembly.

23. The device of claim 22 further comprising:

means for tripping the bit sub out of the wellhead, the bit sub making contact with the drill string adapter;

means for continuing to pull on the drill string removing the coupling of the wear bushing removably coupled to the at least one of the casing hanger in the wellhead and the wellhead; and means for retrieving the drill string adapter coupled to the wear bushing.

24. The device of claim 20 further comprising:

means for leaving the wear bushing in the wellhead on an intermediate drill bit trip by not installing the drill string adapter on the drill string.

* * * * *